US005816917A

United States Patent [19]

Kelmer et al.

[11] Patent Number: 5,816,917

[45] Date of Patent: Oct. 6, 1998

[54] FLOPPY-DISK ENTERTAINMENT AND GAMBLING SYSTEM FOR PERSONAL COMPUTERS

[76] Inventors: Aaron Kelmer; Michael Simon Kelmer, both of 5001 W. Lee St., Skokie, Ill. 60077

[21] Appl. No.: 577,018

[22] Filed: Dec. 22, 1995

Related U.S. Application Data

[63] Continuation-in-part of Ser. No. 514,261, Aug. 11, 1995, abandoned.

[51] Int. Cl.[6] ..... A63F 9/22

[52] U.S. Cl. ..... 463/16; 463/25; 463/43

[58] Field of Search ..... 463/1, 12–13, 463/16, 17–20, 25, 29–31, 40, 43–44; 364/410, 412, 401, 406; 273/292–293, 274, 148 B; 235/380

[56] References Cited

U.S. PATENT DOCUMENTS

| | | | |
|---|---|---|---|
| 3,796,433 | 3/1974 | Fraley et al. | 463/12 |
| 4,738,451 | 4/1988 | Logg | 463/2 |
| 4,858,930 | 8/1989 | Sato | 463/44 |
| 5,022,653 | 6/1991 | Suttle et al. | 463/13 |
| 5,179,517 | 1/1993 | Sarbin et al. | 463/25 |
| 5,261,820 | 11/1993 | Slye et al. | 463/1 |
| 5,267,734 | 12/1993 | Stamper et al. | 463/23 |
| 5,294,120 | 3/1994 | Schultz | 463/13 |
| 5,332,219 | 7/1994 | Marnell, II et al. | 463/13 |
| 5,342,047 | 8/1994 | Heidel et al. | 463/29 |
| 5,356,140 | 10/1994 | Dabrowski et al. | 364/412 |
| 5,375,830 | 12/1994 | Takemoto et al. | 273/143 R |
| 5,393,061 | 2/1995 | Manship et al. | 463/20 |
| 5,429,361 | 7/1995 | Raven et al. | 463/25 |
| 5,470,079 | 11/1995 | LeStrange et al. | 463/25 |
| 5,569,082 | 10/1996 | Kaye | 463/17 |

OTHER PUBLICATIONS

"In–Charge Cards", Electronics Now, Aug. 1993, p. 4.

"Radio Helps Casinos Spot Big Spenders", by Robin James, Reno Gasette–Journal, Jan. 18, 1995, pp. 1C and 3C.

"Gauntlet" game, by Atari Games, Copyright 1985, 6 pages including cover.

"Silent Service: The Submarine Simulation –Tactical Operations Manual," by Micro Prose, Copyright 1985, 9 pages including cover.

*Primary Examiner*—Jessica Harrison

*Attorney, Agent, or Firm*—Robert Toczycki

[57] ABSTRACT

A method of playing a gambling game-device on a standard, conventional personal computer utilizing at least one floppy disk or smart card that is purchased from a licensed vendor or provider. When the disk or smart card is purchased, a predetermined, gambling credit-balance is credited to the "credit balance" field of the "wage-related control information" section of the disk or card. From that credit-balance, the purchaser may bet any desired amount, up to the maximum credited, during the playing of the gambling game. Before the start of play of the game, the player is asked the amount of his wager, whereupon, that amount is deducted from the "credit-balance" field and debited to the "debit-field". After having played the gambling game, the winnings, if any, are then credited to the "credit-field", or the losses, if any, are debit to the "debit-field" of the disk or card. After the player has used up all of the credit-balance, or if the credit-balance has reached a predetermined maximum, by means of one or more winnings, then the disk or card having the "wage-related control information" section is returned to the vendor or provider, for either the purchase of a new "credit-balance", or for the collection of the monies won. In a variation, a dedicated, portable computer unit is provided for use with a smart-card reader incorporating the gambling game software therein.

8 Claims, 11 Drawing Sheets

FLOPPY-DISK ENTERTAINMENT AND GAMBLING SYSTEM FOR PERSONAL COMPUTERS

CROSS REFERENCE TO RELATED APPLICATION

This application is a continuation-in-part of application Ser. No. 08/514,261, filed on Aug. 11, 1995, now abandoned, of the same inventor.

BACKGROUND OF THE INVENTION

The present invention is directed to a method of playing a game of entertainment on a personal computer, which has the option of playing the game as a game of chance, or for gambling, which game of change, or gambling, is carried out by means of a floppy disk, which floppy disk has a pre-credited betting balance contained therein, which initially is credited to the floppy disk at the time of purchase of the floppy disk from a licensed vendor or provider.

It is known to use "debit" or "credit" cards for playing a gambling device. Examples of such "debit" and "credit" card systems are disclosed in U.S. Pat. No. 5,083,271. The use of a "smart" card, in which both debiting and crediting of the card may take place, is disclosed in U.S. Pat. No. 5,179,517, and in British Patent No. 2,275,806. However, these prior-art systems require the use of the card in conjunction with a specific, dedicated computerized gambling game-device, which are extremely costly and complex machines.

SUMMARY OF THE INVENTION

It is the primary objective of the present invention to provide a method and system of playing a gambling game-device which utilizes a standard and conventional personal computer (PC), such as an IBM-compatible PC or Apple PC, so that any person owning, or able to access, a personal computer may play a game of chance or bet on an outcome of a game played on the personal computer.

It is another objective of the invention to provide such a method and system of playing a gambling game-device which utilizes a standard and conventional personal computer (PC) in which the games and the wager-related control-information are provided on one or more floppy disks.

It is, yet, another objective of the invention to provide such a method and system of playing a gambling game-device which utilizes a standard and conventional personal computer, where the games and the wager-related control-information are provided on one or more floppy disks, such that the floppy disk, in which is contained the wager-related control-information, may be purchased at a remote vendor, or provider, with a pre-selected credit-balance thereon, from which credit-balance the purchaser wagers, or best, during the playing of the gambling-game.

Toward these and other ends, the method and apparatus of playing a gambling game-device comprises a standard, conventional personal computer and at least one floppy disk that is purchased from a licensed vendor or provider. When the floppy disk is purchased, a predetermined, gambling credit-balance is credited to the "credit balance" file of the "wager-related control information" section of the floppy disk. From that credit-balance, the purchaser may bet any desired amount, up to the maximum credited, during the playing of the gambling game. The gambling itself may be a conventional, standard personal-computer game, such as solitaire, or may be a customized game. Before the start of play of the game, the player is asked the amount of his wager, whereupon, that amount is deducted from the "credit-balance" file and debited to the "waged-bet" file. After having played the gambling game, the winnings, if any, are then credited to the "credit-file", or the losses, if any, are debited thereto. After the player has used up all of the credit-balance, or if the credit-balance has reached a predetermined maximum, by means of one or more winnings, then the floppy disk having the "wager-related control information" section is returned to the vendor or provider, for either the purchase of a new "credit-balance", or for the collection of the monies won, as shown in the "credit-balance" file, in which case the winner may also purchase a new, initial credit-balance from his or her winnings, or simply purchase a new floppy disk having the predetermined, standard credit-balance therein.

In a variation, instead of using a floppy disk, or two floppy disks, a smart-card may be used. The smart-card may be used in conjunction with a personal computer incorporating commercially-available smart-card readers. Alternatively, a dedicated, hand-held, portable computer unit may be provided for use with the smart-card.

BRIEF DESCRIPTION OF THE DRAWINGS

The invention will be more readily understood with reference to the accompanying drawing, wherein:

FIGS. 1 through 6 are flow charts showing the operation of the method and apparatus of playing a gambling game-device utilizing a standard, conventional personal computer and two floppy disks, where the first floppy disk contains the gambling game itself, and where the second floppy disk contains the wager-related control information, such as credit-balance, wager-balance, control functions between the first gaming diskette and the credit and debit balances, and the like;

DETAILED DESCRIPTION OF THE INVENTION

Figure 1:
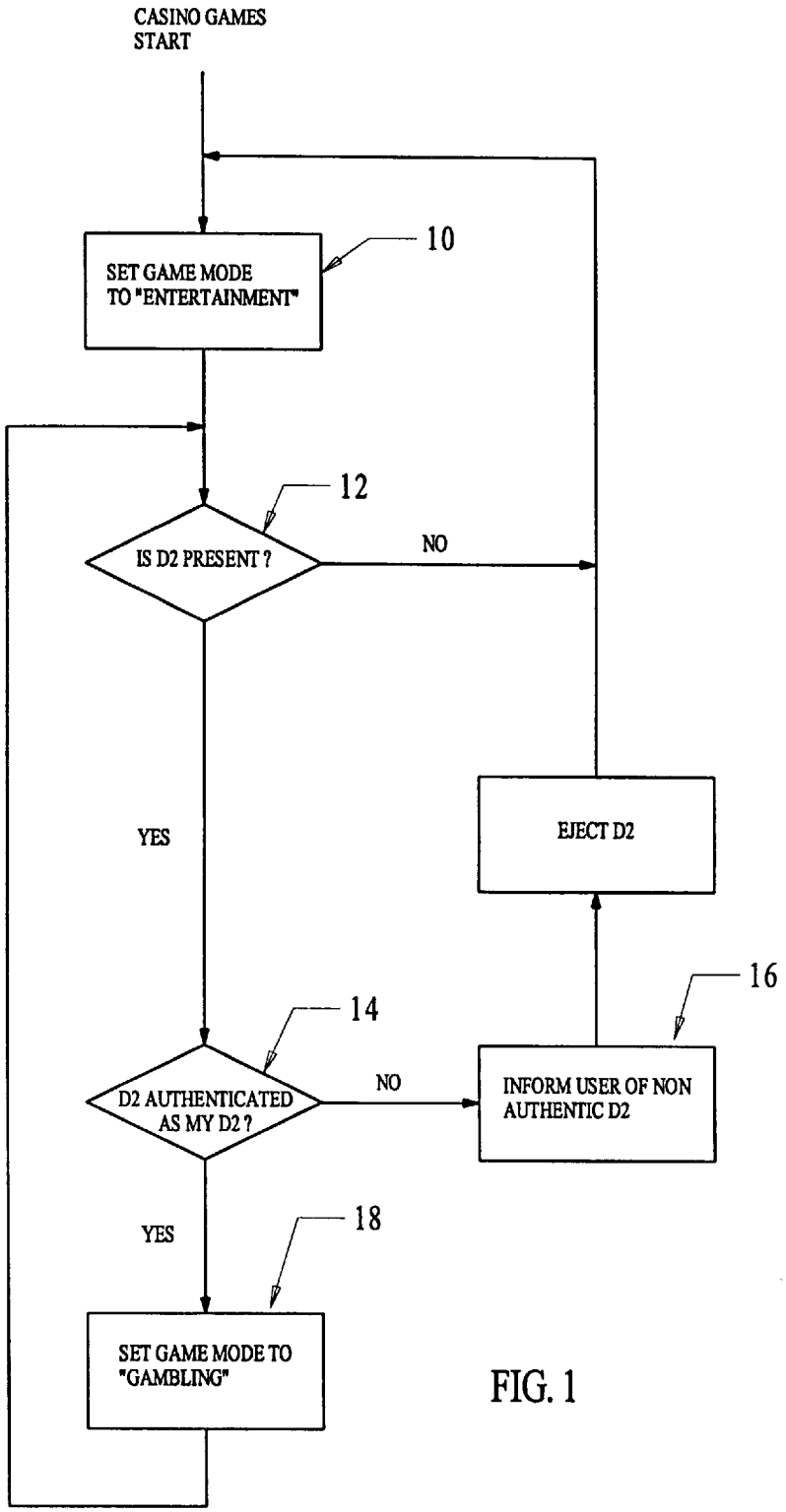

Referring now to the drawings in greater detail, and to FIGS. 1–6, for the case where there are two floppy disks provided—a first one D1 containing the gambling/entertainment game or games, and a second one D2 containing the "casino-bank" with wager-related information—the part of the software program on disk D1 is shown in FIGS. 1–4, and at the initiation of set-up (FIG. 1, block 10), the player sets the game mode to entertainment, which allows the gambling game to be played simply for fun, or for gambling. The program then checks to see if the second floppy diskette D2 is present (block 12), which second floppy has the "banking" wager-related control information thereon. If the second floppy diskette D2 is not present, then the program halts, returning to "Start" until the presence of the second floppy D2 is sensed. After the second floppy has been sensed, then the program tries to authenticate the second floppy as belonging to the player (block 14), with the proper entry of a password or security code. If the password or security code does not match, then an error message (block 16) is indicated, informing the player of such. After authentication of the second floppy disk D2, the program then allows the player to enter in the gambling mode (block 18), so that, if the player decides to play the game for gambling, he will be allowed to do so.

The player is now ready to play the game, but before doing so, the system of the invention first determines if the player is playing for fun ("entertainment" mode), or if he is gambling ("gambling" mode). The program first requires that the game-mode be set to "entertainment" (FIG. 2, block 20), so that the game may be played even if not for gambling, if, for example, the player wants to first practice before actually betting. The program hen determines if the player chose the "gambling" mode (block 22). If not, then the program goes directly to the selection of a game to be played (block 24)—if the floppy disk D1 has more than one game to be played. If the mode selected is "gambling", then the program determines the state of the second floppy disk D2 (block 26) to see if it still enabled (block 28), which means that there is still a minimum credit-balance, or that the maximum credit-balance has not be surpassed. If neither is true, then program checks to see if the "print-enabled" state of the second floppy disk is present (block 30), which means that the player has decided to quit further gambling in order to cash in the D2 floppy, with the program going to FIG. 5, discussed below, and the game is not allowed to be played. If the "print-disabled" state is not present, then the program proceeds to FIG. 4, to see if the player wishes to enable the "PRINT" command to thereby quit gambling, and to redeem the floppy or to purchase a new credit-balance. If the second floppy D2 is enabled, then the player chooses the game he wishes to play (block 24), and the program checks to see if a game has been selected (block 32). If a game has not been selected, then the program diverts to FIG. 4, for performing the "FINISH" routine. If a game has been selected, then the program proceeds to the waging or betting sub-routine (FIG. 3).

Figure 2:
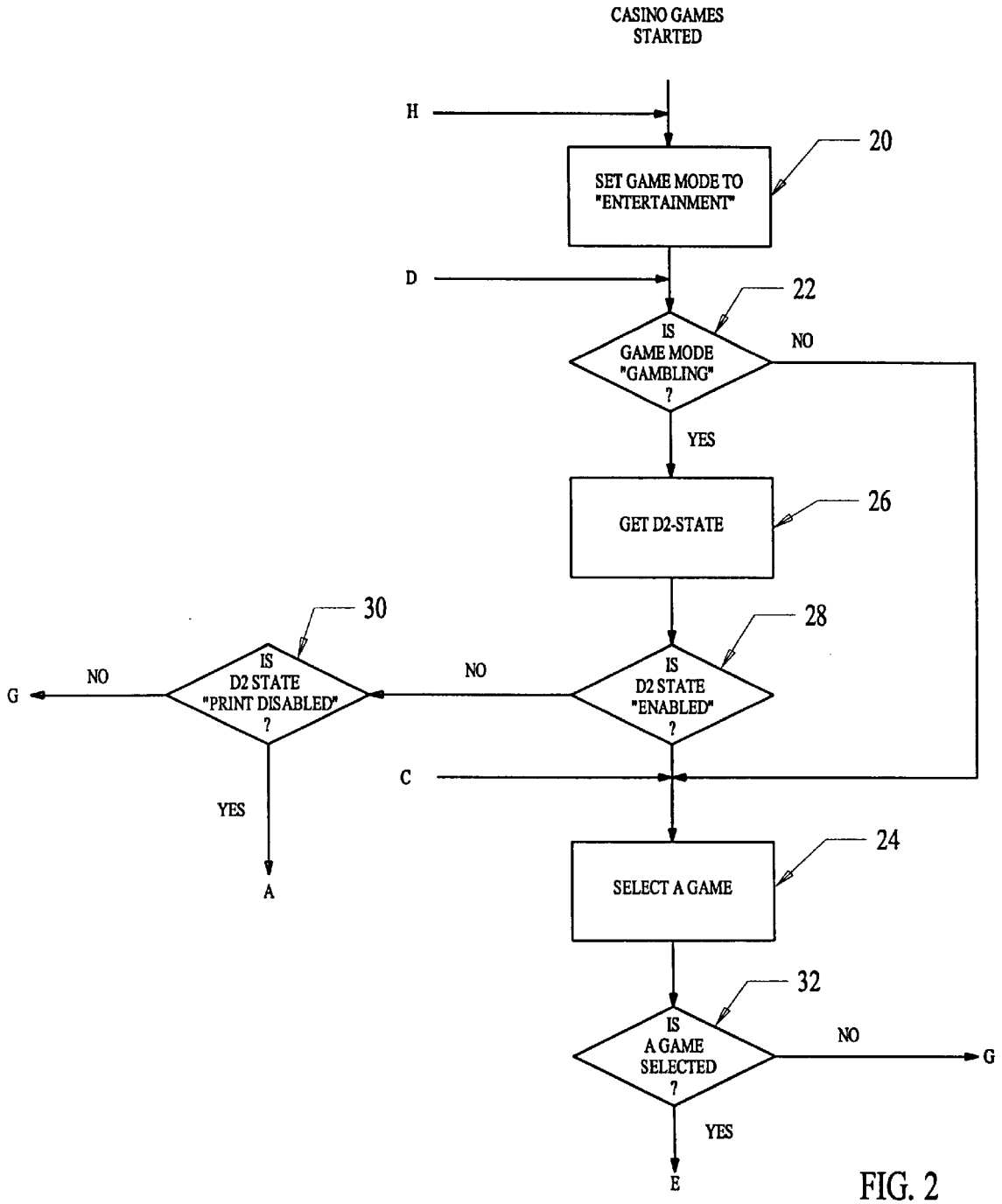
Figure 3:
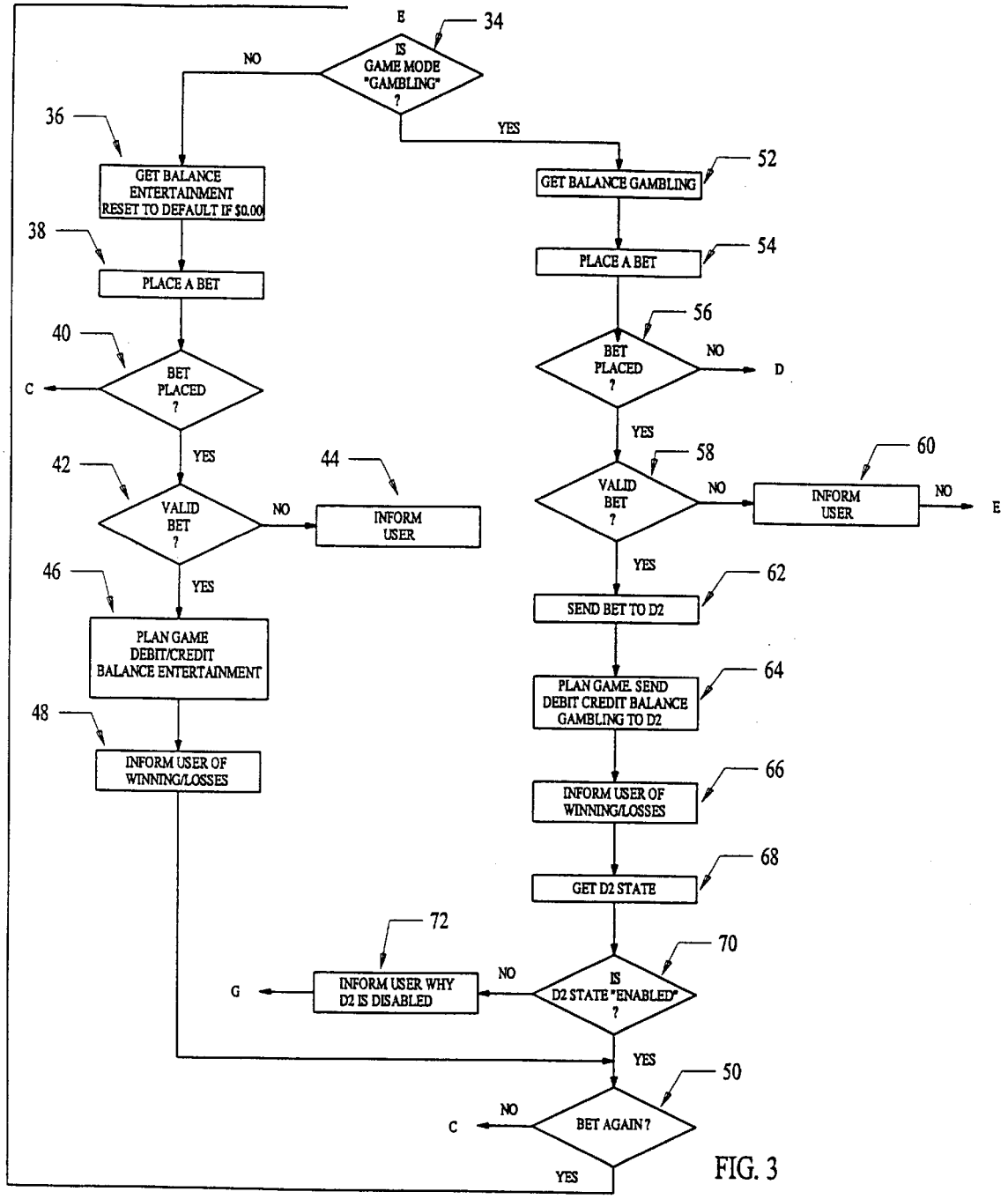

In FIG. 3, the program determines if the player has selected the "gambling" mode, or the "entertainment" mode (block 34). If the "entertainment" mode has been set, then the player may play the game for fun, but still betting, in order to "try out" the game for practice, before actually gambling. The program retrieves the credit-balance for the "entertainment" mode, if the game has been played before and there were winnings, or the balance is set to zero if not played before (block 36). The program then instructs the player to place a bet (block 38), and then determines if such has been done (block 40). If not, the program returns to block 24 of FIG. 2, to allow the player to pick a different game. If a bet has been detected, then the program checks to see if it is a valid bet (block 42). If it is not a valid bet, if, for example, it is too large, then the player is so notified (block 44). If it is a valid bet, then the player is allowed to play the game (block 46). After the game has been played, any debit or credit is indicated to the player (block 48), while that debit or credit is subtracted or added, respectively, to the "credit-balance" file of the "entertainment" mode section of the floppy disk D2. The program then asks the player if he would like to play the game again (block 50); if "YES", the program returns to block 34, and if "NO", the program returns to block 24 of FIG. 2, so that the player may select another game.

If the player has chosen the "gambling" mode in decision block 34, then the program goes to the "gambling-mode" section of the second "banking" floppy D2 and retrieves the gambling credit-balance (block 52) from the "gambling-mode" section of the floppy D2. The program then instructs the player to place a bet (block 54), and determines if the bet has been placed (block 56). If "NO", the program goes back to determine the status of disk D2 (FIG. 2, block 22), and if D2 is not disabled, then the program will return to block 34 after passing through blocks 24 and 32 of FIG. 2. If a bet has been place, then the program determines if a valid bet has been placed (block 58). If not, the player is informed (block 60), and the program returns to block 34 for allowing the player to replace the bet. If a valid bet has been placed, which means that the credit-balance in the "gambling-mode" section of D2 is large enough to cover the bet, or that the bet meets other requirements, such as not exceeding a maximum amount, then the bet is sent to the floppy D2 for debiting the credit-balance of the "gambling mode" section of D2 (block 62). Thereafter, the player plays the game (block 64), with any debit or credit being indicated to the player (block 66), while that debit or credit is subtracted or added, respectively, the "credit-balance" file of the "gambling mode" section of the floppy disk D2. The program then determines the status of D2 (block 68), to see if it is still "enabled" (block 70). If it is not disabled, then the program asks the player if he or she would like to bet again (block 50), as in the case of the "entertainment" mode described above. If the "banking" disk D2 has been disabled, the program so informs the user (block 72), and the program exits to the "PRINT" routine, where the player may then elect to send the floppy D2 back to the vendor or provider for collection of monies won, or for purchasing a new credit-balance. The floppy D2 is disabled if the credit-balance drops to zero or a minimum balance, or exceeds a maximum balance. When the floppy D2 is disabled, the gambling-mode is, thus, disabled.

Figure 4:
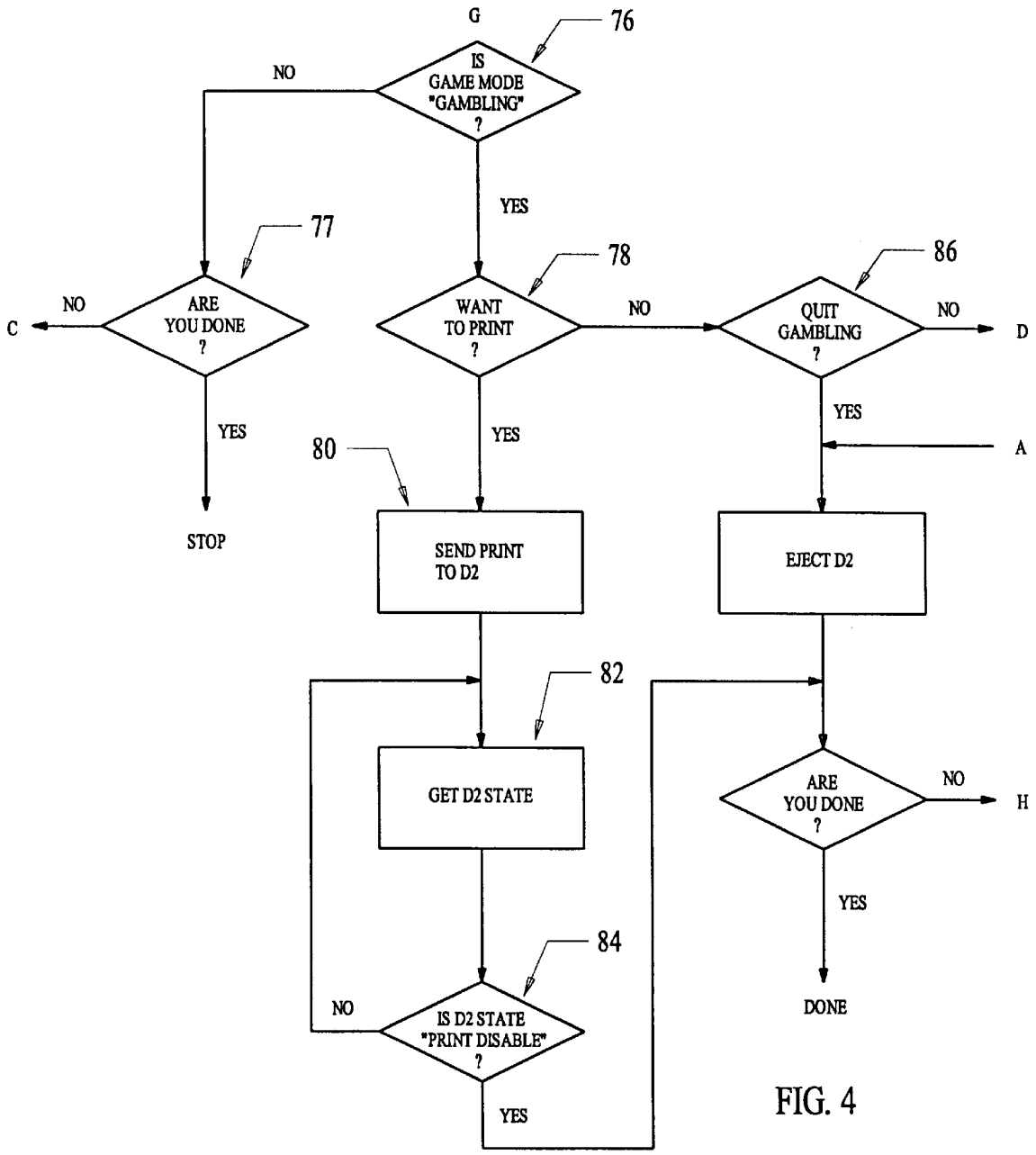

In FIG. 4, there is shown the "PRINT" subroutine. The program first determines if the mode that has been played is "gambling" or "entertainment" (block 76). If it is "entertainment", since the "PRINT" command is only relevant to the "gambling" mode, the program simply asks if the player is finished (block 77). If "YES", then the session ends. If "NO", then the program goes back to block 24 of FIG. 2, for a selection of another game. If the mode is "gambling", then the program will determine if the player wishes to print the data contained in the "credit-balance" file of the gambling-mode section of the floppy D2. The "PRINT" subroutine is only performed when one wishes to disable the floppy D2 in order to either collect on the winnings, or for purchasing a new credit balance from the vendor or provider. The player may be given no choice but to request the print command, if the credit balance has fallen below a minimum or is zero, or if the credit balance has reached or passed a maximum. The player may, also, wish to "print" even though the credit balance of the "gambling" mode is not at a minimum or maximum, if he simply wants to cash in on the credit-balance now showing, which is accomplished by means of the subroutine shown in FIG. 2, as previously described, at block 32 thereof. Thus, the subroutine of FIG. 2 may entered just for the purpose of entering the "PRINT" subroutine of FIG. 4. The program determines if the player wishes to print (block 78), and if "YES", then the "SEND" command is sent to floppy disk D2, whereupon the credit-balance data is printed out. The sending of the "PRINT" command (block 80) to D2, first causes the program to get the status of D2 (block 82). The program then determines if D3 has been "print" disabled or not (block 84). If "NO", the program loops back until the credit-balance of gambling mode section has been printed out. If "YES", then the program determines if the player would like to play again, with only the "entertainment"

mode being now available. If the player wishes to continue playing, the program goes back to the block 20 of FIG. 2, for the start of a new game, which can only be played under the "entertainment" mode, as indicated by blocks 22–32 of FIG. 2.

In FIG. 4, if the decision was made not to print (block 78), then the program asks if the player would like to quit gambling (block 86), and if "YES", then the program allows the player to enter the "entertainment" mode by returning to block 20 of FIG. 2. If the answer is "NO", then the program returns to block 22 of FIG. 2, which will give the player another chance to "print-disable" the floppy D2.

Figure 5:
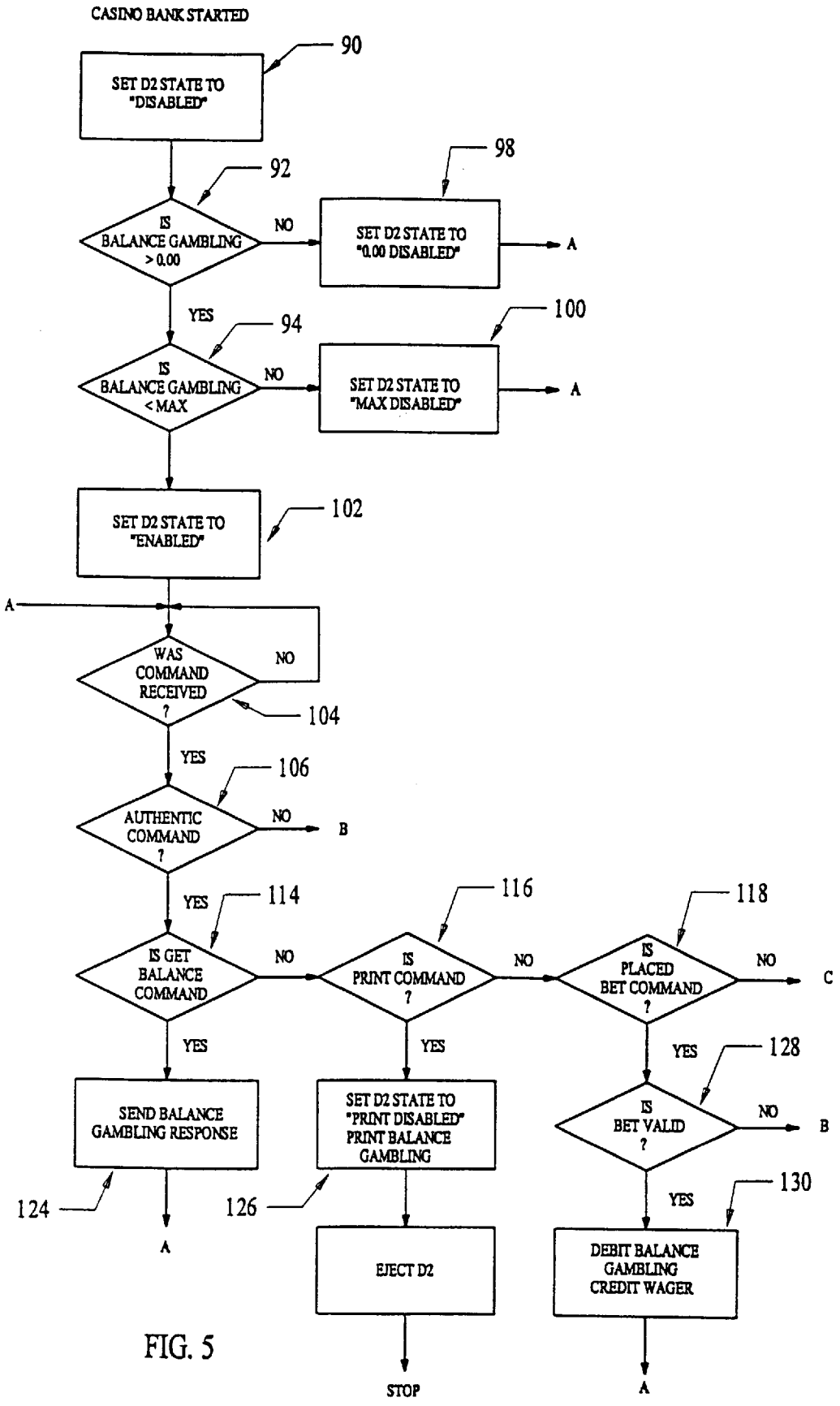
Figure 6:
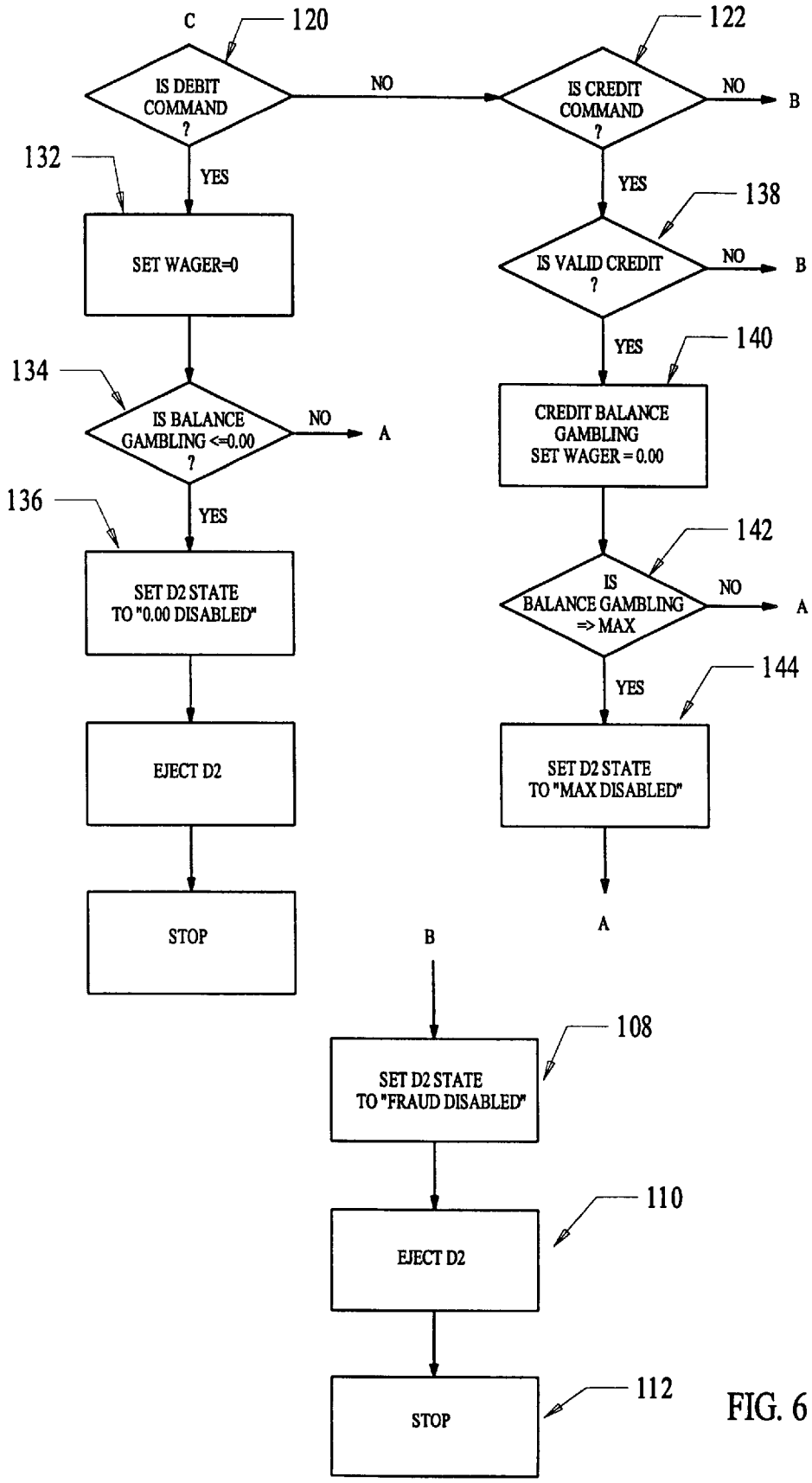
Figure 7:
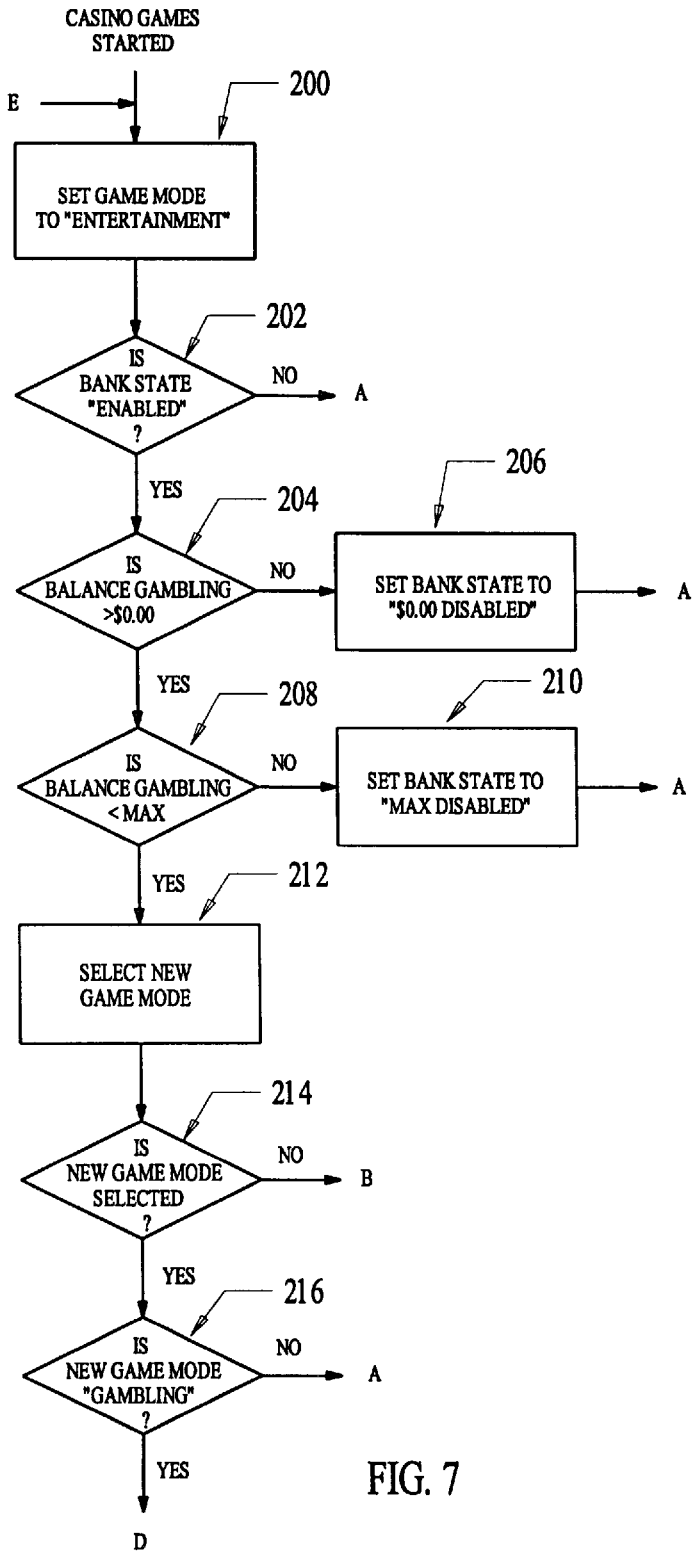
FIGS. 7 through 10 are flow charts showing the operation of the method and apparatus of playing a gambling game-device utilizing a standard, conventional personal computer and one floppy disk, where the one floppy disk contains the gambling game itself, and the casino-bank-state, wager-related control information.

FIGS. 5 and 6 show the software from the second floppy disk D2, which is called the "Casino Bank" disk, because the wager-related control information is contained thereon. In FIG. 5, there is shown the "Disk-Status" subroutine performed by the program on floppy D2 is initially set at "Disabled" (block 90). The software then determines if the "credit-balance" file of the gambling mode is greater than zero or less than the maximum allowed (blocks 92, 94). If either answer is "NO", then the floppy D2 is disabled with the appropriate status flag being set as being either "minimum" or "maximum" (blocks 96, 98). If the answer is "YES", then the floppy D2 is set to "enabled" (block 102). If it is not an authentic command, the program assumes fraudulent tampering, and the disk D2 is disabled by setting the "fraud-disabled" flag (blocks 108–112 of FIG. 6). If it is an authentic command, the software determines which one of the five valid commands it is: "GET-BALANCE" command (block 114), "PRINT" command (block 116), "BET-PLACED" command (block 118), "DEBIT" command (block 120), or "CREDIT" command (block 122). in reply to the "GET-BALANCE" Command, which originated from block 52 of FIG. 3, the program sends the data to the subroutine there (block 124). In response to the "PRINT" command, emanating from block 80 of the subroutine of FIG. 4, the program sets the D2 state to "Print Disabled", so that the gambling mode has been disabled, and the floppy must be returned to the vendor or provider for redemption, or for the purchase of a new credit-balance. If the command is "PLACED-BET" command emanating from block 58 of FIG. 3, the program determines if it is a valid bet (block 128). If it is not a valid bet, which means it must be a preset minimum opr maximum, then the program exits via the "fraud-disabled" routine of FIG. 6 (block 108). If it is a valid bet, then the "credit-balance" file of the gambling mode is debited (block 130), while a similar amount is credited to the "wager" file. If the command is a "DEBIT" command emanating from block 64 of FIG. 3, indicating the player has lost, then the "wager" file is reset to zero (block 132) for receiving the next bet, and the "credit-balance" file is checked to see if it is below or equal to zero (block 134), to see if further bets may be placed. If "NO", then the subroutine returns back to block 104 to await another command. If "YES", then disk D2 is disabled (block 136), and no more betting may take place, which "disabled" state will be sent to block 28 of the subroutine of FIG. 2 whenever the player tries to gamble again. If the command is a "CREDIT" command, then the security portion of the program determines if it is valid (block 138). If not, the program exits via the "fraud-disabled" subroutine (blocks 108–112), indicating that illegal access to, or tampering with, the credit-balance file has been attempted. If it is a valid credit, then the credit-balance file is credited (block 140) and the "waged-bet" filed is set to zero for the next bet. The program then determines if the balance in the "credit-balance" file is equal to or greater than a predetermined maximum (block 142). This feature is necessary to limit the amount of winnings possible. The "credit-balance" file may exceed the maximum just one, which would occur if the winnings of the last game played was such as to push the credit-balance over the maximum. However, as soon as the credit-balance file reaches or surpasses the maximum, the "maximum-disabled" flag is set, and the disk D2 is disabled (block 144). After all valid commands have been answered, the program returns to block 104 to await the next command.

Referring now to FIGS. 7–11, flow charts are shown for the second embodiment of the invention, in which, instead of two floppy disks D1 and D2, the entire software program, including the game or games, the wager-related control information, including the credit-balance file, and the interfacing software between the games files and the wager-related control information, are all contained on one floppy disk or CD, or are contained on one smart-card. In the case of the smart-card, the personal computer must be equipped with a conventional, smart-card reader. A smart-card is a conventional memory device having its own microprocessor, processor, non-volatile RAM, and supporting electronic circuitry.

At the initiation of set-up (FIG. 7 block 200), the player sets the game mode to "entertainment", which allows the gambling game to be played simply for fun, or for actual gambling. The program then checks to see if the "casino-bank state" is enabled (block 202), which corresponds to the enable-state of second floppy (D2) of the first embodiment, as discussed above. If the "bank-state" is not enabled, then the program will allow the player to play the game for fun, or will allow the player to "print-disable" the bank-state, which is the equivalent of print-disabling floppy D2 of the first embodiment. Thus, the program will route to the subroutine of FIG. 8, discussed hereinbelow. If the "Bank-State" has been enabled, then the program checks if the credit-balance for gambling is greater then zero (block 204); if not, then the program disables the "Bank-State", for obvious reasons (block 206). If the balance is greater than zero, then the program checks if it is above a preset maximum (block 208), and if it is, the "Bank-State" files are again disabled by setting the "maximum-status" flag, as described above with reference to the first embodiment. If the balance is less than the maximum, then player is allowed the option of choosing the game mode (block 212) to either "entertainment" or "gambling". However, the program first checks to see if a mode has been selected (block 214), and if not then the program goes to the "Exit" routine of FIG. 10 (discussed hereinbelow). If the mode chosen it is "entertainment" (block 216), the program is diverted to the game-select subroutine of FIG. 7. If the mode chosen is "gambling", then the program checks the authentication-status of the user, by password, security code, or the like, as described above with the first embodiment (block 218). If security is cleared, then the program automatically sets the game-mode to the chosen "gambling" (block 220), and then asks the player to select his game (block 222). The program first determines if a game has been selected within a predetermined time interval (block 224), and if not, the program diverts to the "Print" subroutine of FIG. 10, since it is assumed that entry as far as block 222 without a game being chosen must be for purposes of closing the bank-state files for redeeming the credit-balance or for purchasing a new credit balance, as described above with the first embodiment, or it is assumed that the player has changed his mind and would rather practice the game first, whereupon the program diverts to the subroutine of FIG. 9 via the "Print" subroutine of FIG. 10, as described hereinbelow. If the player has selected a game, then the program automatically determines if the mode is "gambling" or "entertainment" (block 226). Since the program will typically have arrived to block 226 by means of the "gambling-mode" state, the answer will usually be "YES", and then the program requests from the player the amount of the bet (block 228). However, this betting subroutine may be reached if the player chooses not to gamble a second time, as will be discussed in the subroutine of FIG. 9. If the mode is "entertainment", then the program sets the "entertainment" balance to zero, or to a default value (blocks 230, 232), a bet is placed (blocks 234, 236), and it is determined if it is a valid bet (block 238) which falls within a range of a minimum and maximum. The "credit-balance" file is debited (block 240), the game played (FIG. 9, block 242), and the "credit-entertainment" filed credited if the player has won. The "waged-bet" file is then zeroed out (block 244), and the player informed of his winnings or losses (block 246), and the program asks if he wishes to bet again (block 248), whereupon, if "YES", the program returns to the block 226 of FIG. 8, in order to allow the player to play and bet the same game again under the "entertainment" mode. If "NO", then the program returns to block 222 of FIG. 8, which allows the player to select a different game under the "entertainment" mode. The use of the "entertainment" mode, as herein described, is in order to allow the player to practice before actually playing the game for real betting.

Figure 8:
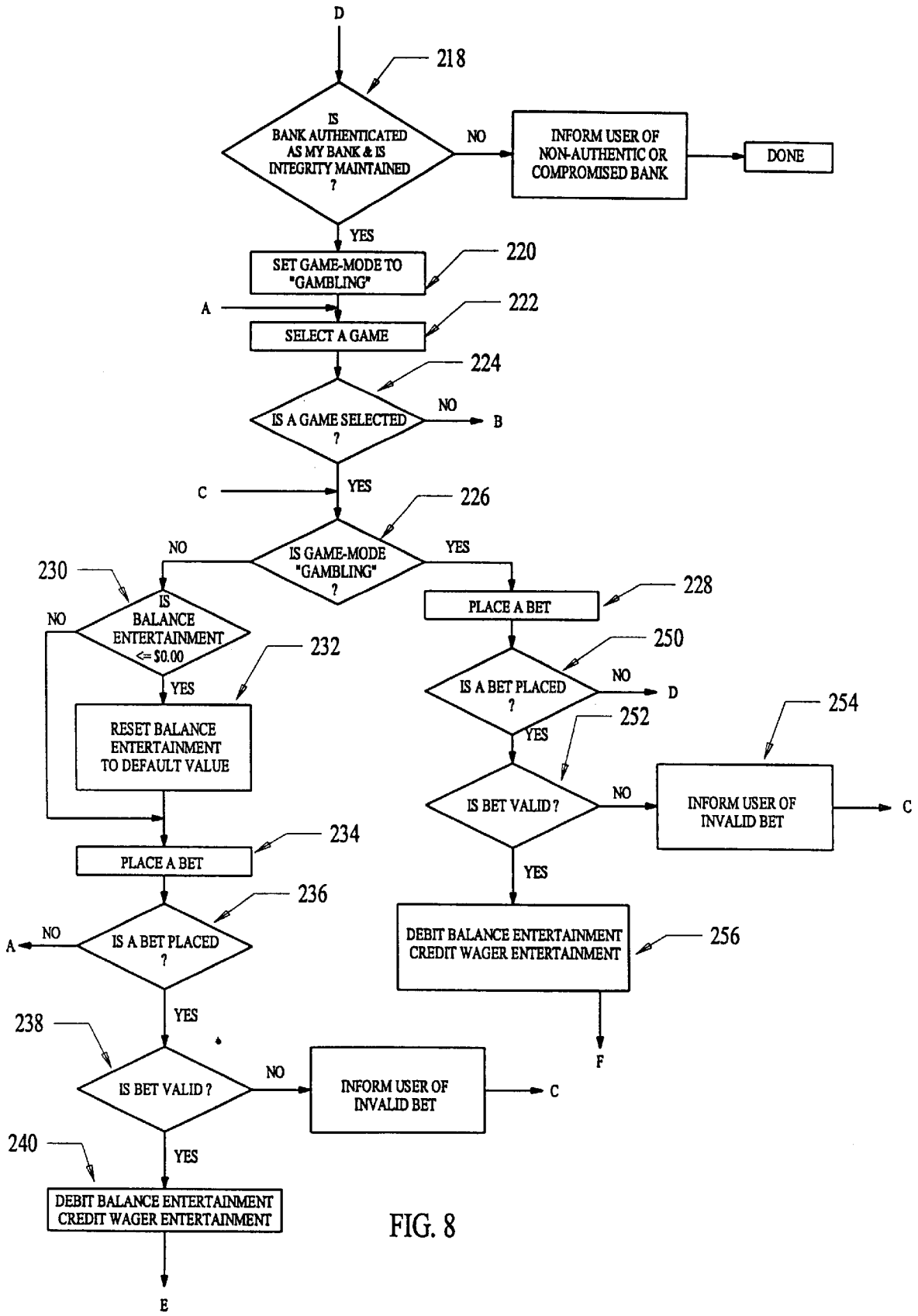

If, in block 226, FIG. 8, the "gambling" mode is present, then after having placed a bet (block 228), the program checks to see if a bet has been placed (block 250), and if not, the program loops back to the block 218, to allow the player a chance to change his mind, and not play the game for real betting. If the bet has been placed, the program checks to see if it is valid (block 252), and if not—for example, was too large or too small, or there were not enough credits in his gambling-mode "credit-balance" file—then the program informs the user of this (block 254), and the program loops back to block 226 in order to give the player another chance to make a correct bet. If the bet is a valid bet, then the "credit-balance" file for the gambling mode is debited, and the gambling-mode "waged-bet" file credited (block 256). Then, the player plays the game (FIG. 9, block 258), upon which any winnings are credited to his "gambling-mode""credit-balance" file, while the "waged-bet" file is zeroed out for the next wager (block 260). The program then checks to see if the gambling-mode "credit-balance" file is less than or equal to zero (block 262), and if it is, the "bank state" is disabled, as described above with the first embodiment and disk D2 (block 264), whereupon the player is informed of his winnings or losses (block 266). If the gambling-mode "credit-balance" file is greater than zero, then the program checks if the balance is over the preset maximum (block 268), and, if it is, the "bank-state" is disabled by setting the "maximum" status flag (block 270), and the player is so informed of his winnings (block 266). If the balance is not zero or a maximum, then the program simply informs the player of his winnings or losses for that game played (block 266). The program next checks to see if the bank-state has been disabled (block 272). If not, the program goes to block 248, where the player may elect to bet again by returning to block 226 of FIG. 8, or may elect not to bet again, but rather play another game under the gambling mode, whereby the program returns to block 222 of FIG. 8.

Figure 9:
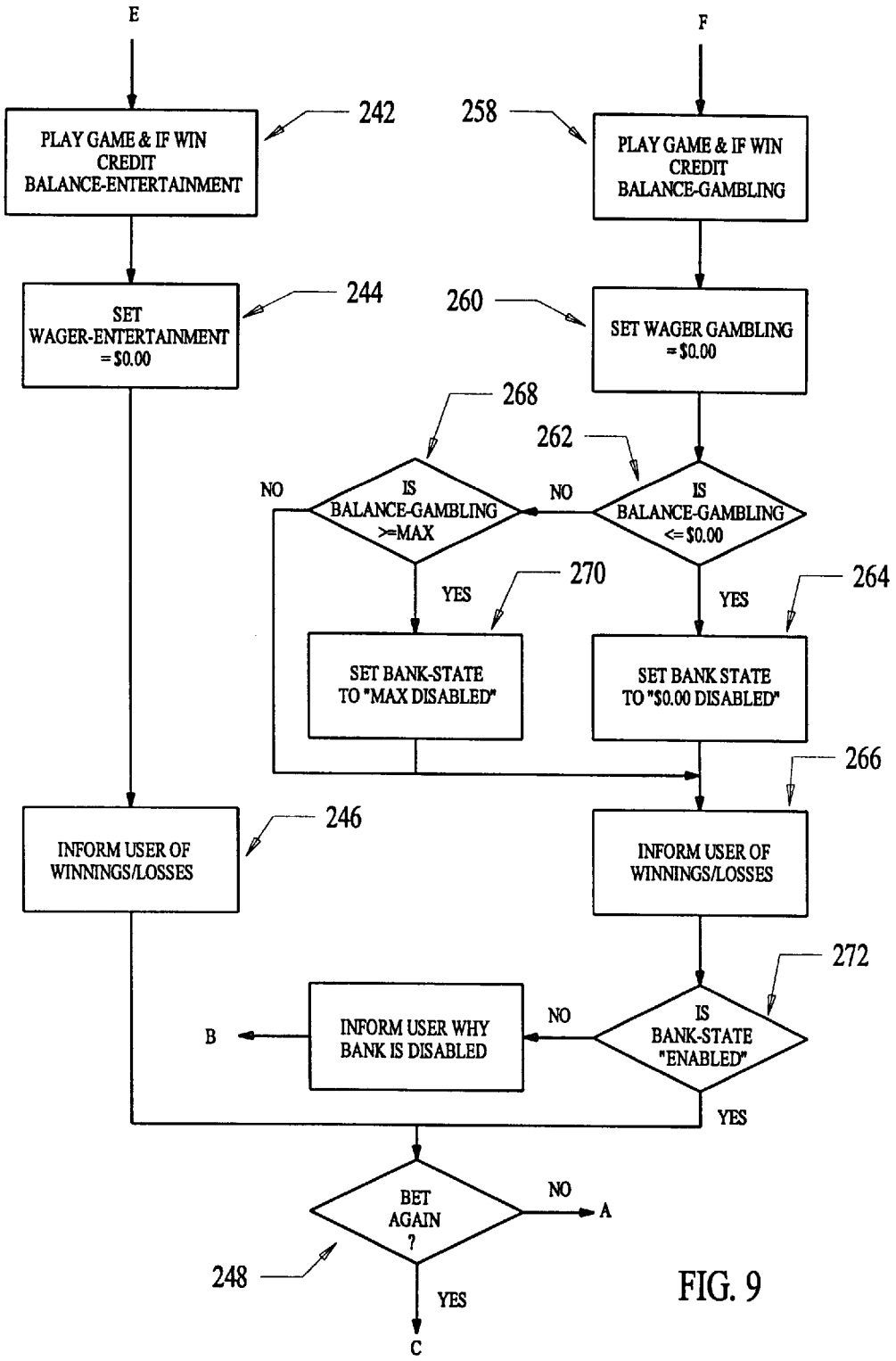
Figure 10:
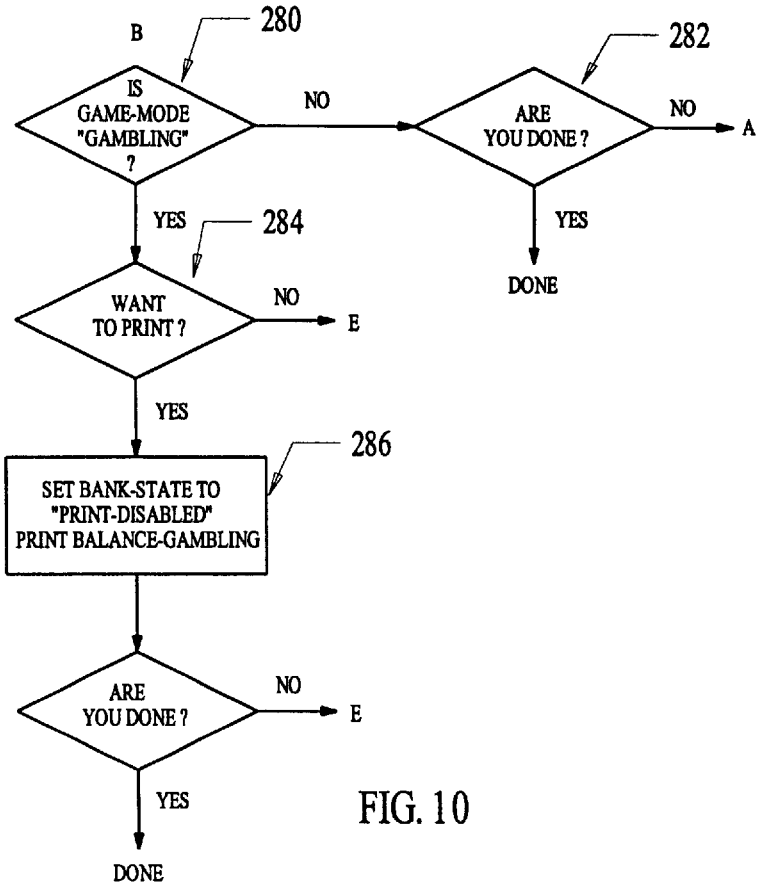

FIG. 10 shows the "Exit" routine, at which may be arrived via blocks 214 (FIG. 7), block 224 (FIG. 8), or from block 272 (FIG. 9). The "Exit" routine first checks to see if the mode selected has been the "gambling" mode (block 280), and if not, which means "entertainment" mode was selected, then the program asks the player if he or she is done (block 282), and if "YES", the program exits. If "NO", then the program returns to block 22 of FIG. 8, in order for the player to select another game, or the same game, to play. If the mode selected was "gambling", then the program asks the player if he wants to print the "credit-balance" file (block 284). If "NO", then the program returns to block 200 of FIG. 8, in order for the player to start over, and, if he wants, play a game under the "entertainment" mode. If the player wants to print, meaning that he wishes to "print-disable" the casino-bank, which prevents further transactions from being credited or debited to the "bank-state" files, then the bank-state is disabled (block 286). The player may choose to print-disable the bank-state files if he wishes to collect his winnings, or wishes to purchase new credits from a purchaser or vendor.

The disk, disks or smart card upon which the programs of the invention are contained are suitable for use with the IBM-compatible or APPLE personal computers, including laptop or portable computers. INSERT HERE WHAT GAMES MAY BE PLAYED.

Figure 11:
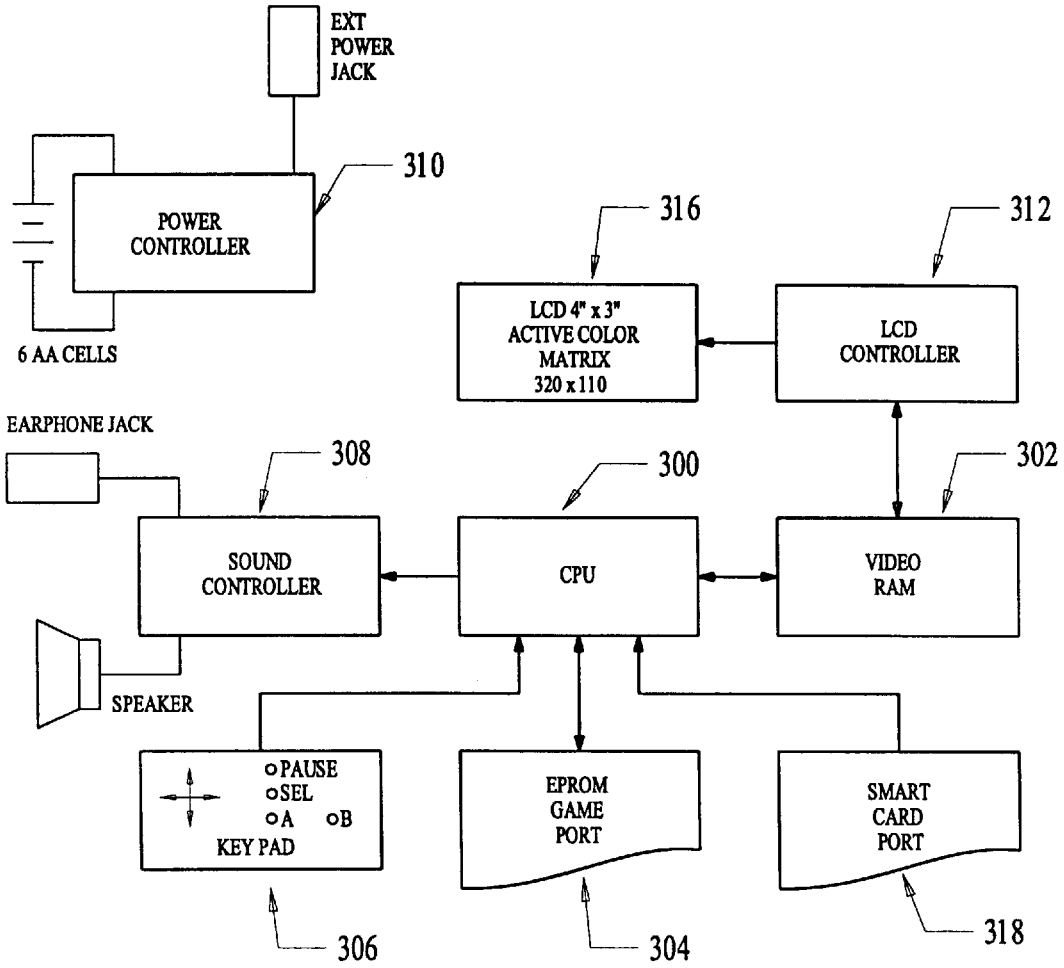
FIG. 11 is a block diagram showing a variation of the invention in which a dedicated, hand-held, portable computer unit is provided for use with a smart-card.

Referring now to FIG. 11, there is shown a block diagram for a dedicated, hand-held, portable personal computer unit, such as a laptop computer, that reads the smart card, referreed to above with reference to FIGS. 7–10. The dedicated, hand-held, portable computer unit of FIG. 11 operates in the manner and fashion as described above for the use of a smart card or floppy in a personal, desk-top computer. Toward that end, the dedicated, hand-held, portable computer unit of FIG. 11 has a conventional microprocessor or CPU (block 300) controlling the operation and functioning of a video RAM (block 302), EPROM memory card (block 304), a keypad (block 306), a sound controller board (block 308), and is powered by a power source (block 310). The video RAM controls an LCD controller 312 of and LCD display 314. The dedicated, hand-held, portable computer unit of FIG. 11 also includes a conventional, integral, smart-card reader (block 318) for reading and writing onto the gambling-game smart card described above in reference to FIGS. 7–10. The dedicated, hand-held, portable computer unit of FIG. 11 operates and functions, and is used, in the same manner as described above for the personal, desk-top computer embodiment of FIGS. 7–10, and differs inly in the small, hand-held size of the unit.

While specific embodiments of the invention have been shown and described, it is to be understood that numerous changes and modifications may be made therein without departing from the scope, spirit and intent of the invention as set forth in the appended claims.

What I claim is:

1. In a personal computer having an operating system, at least one computer memory drive means for receiving and reading data from a disk or smart card, and a computer memory means, the improvement comprising:

said computer memory means comprising at least one of a floppy disk, compact disk, or smart card, and having gambling bank-state credit-data file means storing data-information with respect to the amount owed for playing a gambling game on the personal computer, and waged-bet data file means;

data means stored on said computer memory means representing a gambling-game which is played on a personal computer;

interfacing bank-state data file means for interfacing said gambling bank-state credit-data file means, said waged-bet data file means, and said data means representing a gambling-game, whereby, upon a player waging a bet, and playing the gambling game on said personal computer, in order to win an amount that is credited to said gambling bank-state credit-data file means;

said computer memory means further comprising a credit-data-file disabling data means, said credit-data-file disabling means disabling said gambling bank-state credit-data file means upon said gambling bank-state credit-data file means having reached a predetermined minimum or maximum, said credit-data-file disabling means preventing play of said data means representing a gambling-game.

2. The personal computer according to claim 1, wherein said computer memory means further comprises entertainment-mode bank-state data file means which allow the player to practice the game before gambling, said entertainment-mode bank-state data file means comprising an entertainment-mode credit-data file means, an entertainment-mode waged-bet file means, and interfacing bank-state data file means for interfacing said entertainment-mode, credit-data and waged-bet files with said data representing a gambling-game.

3. The personal computer according to claim 1, wherein said computer memory means further comprises print-disabling data means which prevents access to said gambling bank-state credit-data file means after the data from said gambling bank-state, credit-data file means has been printed out by means of a PRINT command from said personal computer, whereby all of said gambling bank-state credit-data file means are disabled.

4. A method of using a personal computer for playing a game of chance, which personal computer comprises at least one of a floppy drive, compact-disk drive, and a smart-card reader from receiving and reading data from one of a floppy disk, compact disk, and smart card, the floppy disk, compact disk, or smart card having bank-state files with one file thereof being a credit-balance file storing information regarding the monetary value for betting and for collecting, said method comprising:

(a) inserting one of at least one floppy disk, compact disk, and smart card into one of a disk drive and smart-card reader of the personal computer, where said at least one of a floppy disk, compact disk and smart-card comprising at least one gambling game, and a gambling bank-state credit-data file showing the results of playing a gambling game;

(b) playing a gambling game on the personal computer, whereby the player will win or lose a certain amount;

(c) before said step (b), waging a bet, said step of waging a bet comprising debiting the gambling bank-state credit-data file; and (d) automatically crediting or debiting data in the gambling bank-state credit-data file on the at least one of the floppy disk, compact disk, and smart card based on a result of said step (b) in accordance with the amount waged by said step (c); and (e) redeeming said at least one floppy disk, compact disk, or smart card, said step of redeeming comprising returning the data of said gambling bank-state credit data file of said at least one disk, compact disk, or smart card to a vendor for receiving the monetary value indicated in said gambling bank-state credit-data file.

5. The method using a personal computer for playing a game of chance according to claim 4, wherein said step (c) comprises wagering a bet within a predetermined minimum and maximum amount.

6. The method of using a personal computer for playing a game of chance according to claim 4, further comprising disabling the gambling bank-state credit-data file upon the gambling bank-state credit-data file having reached a predetermined minimum or maximum, whereby no further actual betting is allowed to take place.

7. The method of using a personal computer for playing a game of chance according to claim 4, further comprising printing the data from the gambling bank-state credit-data file, said step of printing disabling said bank-state credit-data file.

8. The method of using a personal computer according to claim 4, wherein said step (a) comprises inserting said at least one floppy disk, compact disk, and smart card into one of a disk drive and smart-card reader of a hand-held, dedicated personal computer.

* * * * *